US012065855B2

(12) United States Patent
Wang et al.

(10) Patent No.: US 12,065,855 B2
(45) Date of Patent: Aug. 20, 2024

(54) SWIMMING POOL CLEANING ROBOT WITH MOVEMENT STATE DETECTION FUNCTION

(71) Applicant: Shenzhen Aiper Intelligent Co., Ltd., Shenzhen (CN)

(72) Inventors: Yang Wang, Shenzhen (CN); Xueliang Yu, Shenzhen (CN); Keke Wang, Shenzhen (CN)

(73) Assignee: SHENZHEN AIPER INTELLIGENT CO., LTD., Shenzhen (CN)

( * ) Notice: Subject to any disclaimer, the term of this patent is extended or adjusted under 35 U.S.C. 154(b) by 246 days.

(21) Appl. No.: 17/843,032

(22) Filed: Jun. 17, 2022

(65) Prior Publication Data

US 2023/0313548 A1 Oct. 5, 2023

(30) Foreign Application Priority Data

Apr. 1, 2022 (CN) ..... 202210348990.2

(51) Int. Cl.
*E04H 4/16* (2006.01)

(52) U.S. Cl.
CPC ..... *E04H 4/1654* (2013.01); *E04H 4/16* (2013.01); *E04H 4/1636* (2013.01)

(58) Field of Classification Search
CPC ..... E04H 4/16; E04H 4/1636; E04H 4/1654
See application file for complete search history.

(56) References Cited

U.S. PATENT DOCUMENTS 4,555,938 A * 12/1985 Boucher ..... G01P 5/07 324/167
6,827,120 B2 * 12/2004 Last ..... E04H 4/101 160/133
8,341,789 B2 * 1/2013 Garti ..... E04H 4/1636 210/167.16
2008/0060984 A1 * 3/2008 Henkin ..... E04H 4/1654 210/91
2011/0301752 A1 * 12/2011 Finezilber ..... E04H 4/1654 901/1
2013/0092193 A1 * 4/2013 Porat ..... B08B 9/093 134/166 R
2014/0262401 A1 * 9/2014 Renaud ..... E04H 4/1654 173/152
2022/0271528 A1 * 8/2022 Farrington ..... E04H 4/1281
2022/0389731 A1 * 12/2022 McQueen ..... E04H 4/1654

* cited by examiner

*Primary Examiner* — Michael D Jennings
(74) *Attorney, Agent, or Firm* — Stein IP, LLC

(57) ABSTRACT

The present disclosure discloses a swimming pool cleaning robot with a movement state detection function, including a main body on which a control module is arranged; a rotating member is rotatably arranged outside the main body; a water fender is also arranged outside the main body; part of the rotating member is located in the water fender; the swimming pool cleaning robot further includes a rotating speed detection assembly used for detecting a rotating speed of the rotating member; and the rotating speed detection assembly is electrically connected to the control module. The moving speed of the swimming pool cleaning robot can be accurately acquired by detecting the rotating member's rotating speed; a movement trajectory of the swimming pool cleaning robot can be controlled by controlling the swimming pool cleaning robot's moving direction; and the entire detection system has a simple and reliable structure and is convenient to maintain.

11 Claims, 4 Drawing Sheets

SWIMMING POOL CLEANING ROBOT WITH MOVEMENT STATE DETECTION FUNCTION

CROSS-REFERENCE TO RELATED APPLICATIONS

This application claims the benefit of Chinese Application No. 202210348990.2, filed Apr. 1, 2022, in the China National Intellectual Property Administration. All disclosures of the document named above are incorporated herein by reference.

TECHNICAL FIELD

The present disclosure relates to the technical field of mobile water body cleaning equipment, in particular to a swimming pool cleaning robot with a movement state detection function.

BACKGROUND ART

A swimming pool is a place for people to swim. During use of the swimming pool, some garbage or bacteria will appear, so the swimming pool needs to be cleaned regularly. A swimming pool cleaning robot (including surface and underwater robots) can automatically clean a swimming pool. In order to ensure the cleaning effect, the movement coverage rate of the swimming pool cleaning robot must be effectively improved. Therefore, a movement trajectory of the swimming pool cleaning robot needs to be controlled to effectively reach all areas that need to be cleaned. This requires real-time detection and acquisition of state information such as a moving speed of the swimming pool cleaning robot, so as to use matching algorithms for control and correction. However, an existing propeller-driven underwater swimming pool cleaning robot cannot directly acquire its own movement state information. An existing wheeled underwater swimming pool cleaning robot often slips, so it cannot directly acquire its own accurate movement state information.

SUMMARY OF THE INVENTION

The technical problem to be solved by the present disclosure is to provide a swimming pool cleaning robot with a movement state detection function.

In order to solve the above technical problem, the technical solution adopted by the present disclosure is as follows: A swimming pool cleaning robot with a movement state detection function includes a main body; a control module is arranged on the main body; a rotating member is rotatably arranged outside the main body; a water fender is also arranged outside the main body; part of the rotating member is located in the water fender; the swimming pool cleaning robot further includes a rotating speed detection assembly used for detecting a rotating speed of the rotating member; and the rotating speed detection assembly is electrically connected to the control module.

The present disclosure has the beneficial effects that the swimming pool cleaning robot is provided with the rotating member and the rotating speed detection assembly used for detecting a rotating speed of the rotating member, so that a moving speed of the swimming pool cleaning robot can be accurately acquired by detecting the rotating speed of the rotating member; the movement trajectory of the swimming pool cleaning robot can be controlled by controlling a moving direction of the swimming pool cleaning robot; the entire detection system has a simple and reliable structure and low manufacturing cost and is convenient to maintain.

REFERENCE SIGNS

Figure 1:
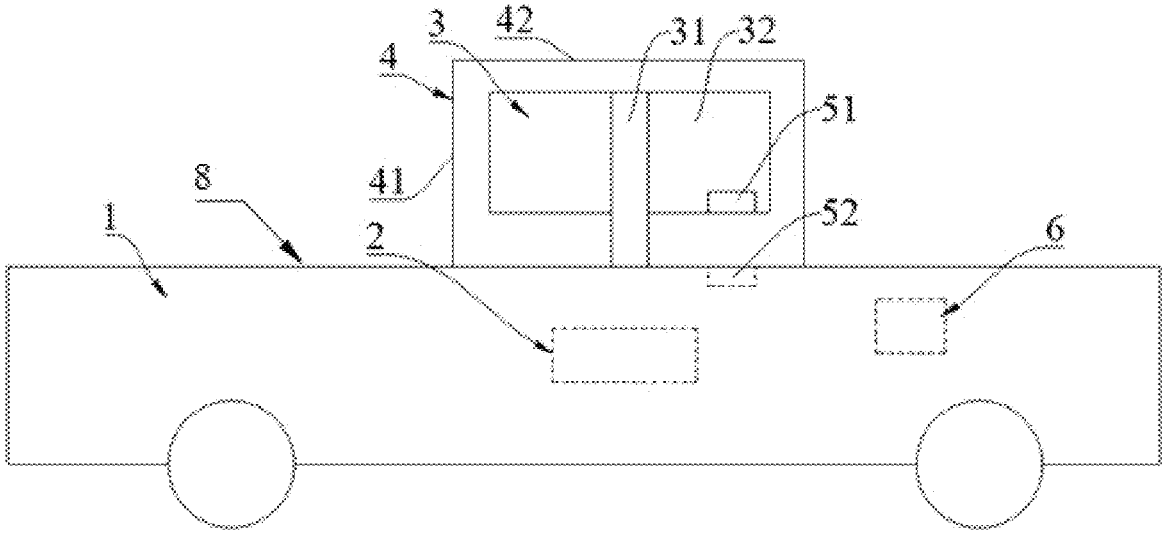
FIG. 1 is a simplified schematic diagram of a swimming pool cleaning robot with a movement state detection function according to Embodiment I of the present disclosure.

1: main body; 11: groove;
2: control module;
3: rotating member; 31: rotating shaft part; 32: vane;
4: water fender; 41: recess part; 42: cover part; 43: guide plate;
5: magnet; 52: detection element;
6: gyroscope sensor;
7: first component: 72: second component.

DETAILED DESCRIPTION OF THE INVENTION

In order to describe the technical content, objectives to be achieved and effects of the present disclosure in detail, descriptions are made below in combination with implementations and accompanying drawings.

Referring to FIG. 1 to FIG. 6, a swimming pool cleaning robot with a movement state detection function includes a main body 1; a control module 2 is arranged on the main body 1; a rotating member 3 is rotatably arranged outside the main body 1; a water fender 4 is also arranged outside the main body 1: part of the rotating member 3 is located in the water fender 4; the swimming pool cleaning robot further includes a rotating speed detection assembly used for detecting a rotating speed of the rotating member 3; and the rotating speed detection assembly is electrically connected to the control module 2.

The principle of this technical solution is described as follows: When the swimming pool cleaning robot moves in water, a water body will drive the rotating member 3 to rotate. A higher moving speed of the swimming pool cleaning robot causes a higher rotating speed of the rotating member 3. Therefore, the moving speed of the swimming pool cleaning robot can be indirectly acquired according to the rotating speed of the rotating member 3.

It can be seen from the above description that the present disclosure has the beneficial effects that the swimming pool cleaning robot is provided with the rotating member 3 and the rotating speed detection assembly used for detecting a rotating speed of the rotating member 3, so that a moving speed of the swimming pool cleaning robot can be accurately acquired by detecting the rotating speed of the rotating member 3; the movement trajectory of the swimming pool cleaning robot can be controlled by controlling a moving direction of the swimming pool cleaning robot; the entire detection system has a simple and reliable structure and low manufacturing cost and is convenient to maintain.

Further, there are a plurality of rotating members 3, and two opposite sides of the main body 1 are respectively provided with the rotating members 3.

It can be seen from the description that the two opposite sides of the main body 1 are respectively provided with the rotating members 3, and the control module 2 can calculate a turning state of the swimming pool cleaning robot by using a speed signal difference value obtained by different rotating members 3.

Further, the rotating speed detection assembly includes a magnet 51 and a detection element 52 which cooperate with each other; the magnet 51 is arranged on the rotating member 3, and the detection element 52 is arranged in a shell 8 of the main body 1. The detection element 52 is a Hall element or a reed pipe.

It can be seen from the description that the magnet 51 is driven to rotate by rotation of the rotating member 3. When the magnet 51 passes through the position of the detection element 52, the detection element 52 is triggered to generate a current/voltage signal. The control module 2 can obtain the number of rotations of the rotating member 3 within unit time according to a signal generation frequency (which can be obtained according to a change in waveforms of the current/voltage signal) within unit time, thus obtaining the rotating speed of the rotating member 3. The moving speed of the swimming pool cleaning robot can be obtained according to a relationship (this relationship can be obtained by calibration) between the rotating speed of the rotating member 3 and the moving speed of the swimming pool cleaning robot. By the adoption of the non-contact rotating speed detection assembly, it can ensure the waterproof performance of the swimming pool cleaning robot, which is conductive to improving the working stability and service life of the swimming pool cleaning robot.

Further, there are a plurality of magnets 51 in the rotating speed detection assembly. The plurality of magnets 51 are uniformly distributed around a central axis of the rotating member 3.

It can be seen from the description that the detection element 52 in the rotating speed detection assembly cooperates with the plurality of magnets 51, which can improve the detection sensitivity and resolution of the rotating speed detection assembly.

Further, there are a plurality of detection elements 52 in the rotating speed detection assembly. The plurality of detection elements 52 are uniformly distributed around a central axis of the rotating member 3.

It can be seen from the description that the magnet 51 in the rotating speed detection assembly cooperate with the plurality of detection elements 52, which can improve the detection sensitivity and resolution of the rotating speed detection assembly. Furthermore, whether the swimming pool cleaning robot suddenly stops or reversely moves can be accurately acquired according to a change in an order that the magnet 51 triggers different detection elements 52.

Further, the rotating member 3 includes a rotating shaft part 31 and a plurality of vanes 32 outwards extending from the rotating shaft part 31.

Further, the rotating shaft part 31 and the vanes 32 are of an integrally formed integrated structure, or the rotating shaft part 31 and the vanes 32 are detachably connected.

It can be seen from the description that in the rotating member 3, when the rotating shaft part 31 and the vanes 32 are of an integrally formed integrated structure, the manufacturing of the rotating member 3 can be facilitated, and the manufacturing cost of the swimming pool cleaning robot is good. When the rotating shaft part 31 and the vanes 32 are detachably connected, if the rotating shaft part 31 or the vane 32 is damaged, the corresponding rotating shaft part 31 or vane 32 is directly replaced, instead of replacing the entire rotating member 3, so that it is conductive to saving the maintenance cost of the swimming pool cleaning robot. Further, the rotating speed detection assembly is a photoelectric sensor assembly; the photoelectric sensor assembly includes a first component 71 and a second component 72 which cooperate with each other; the first component 71 is arranged on the rotating member; and the second component 72 is arranged on the main body.

It can be seen from the description that there are a great diversity of specific structures of the rotating speed detection assembly, which is conductive to enriching the diversity of the swimming pool cleaning robot.

Further, a gyroscope sensor 6 electrically connected to the control module 2 is also arranged on the main body 1.

It can be seen from the description that by the arrangement of the gyroscope sensor 6, an angle state of the swimming pool cleaning robot can be measured, so that the detection accuracy for a movement state of the swimming pool cleaning robot is further improved, and the control accuracy for a movement trajectory of the swimming pool cleaning robot is improved.

Further, the water fender 4 is detachably connected to a shell 8 of the main body 1.

It can be seen from the description that the detachable water fender 4 is convenient for machining and molding of the shell 8 of the main body 1 and is also convenient for self-cleaning work of the swimming pool cleaning robot.

Further, the water fender 4 and a shell 8 of the main body 1 are of an integrally formed integrated structure.

It can be seen from the description that since the water fender 4 and the shell 8 of the main body 1 are of an integrally formed integrated structure, so that the swimming pool cleaning robot is more convenient to assemble, thus reducing the manufacturing cost of the swimming pool cleaning robot.

Further, a groove 11 is formed in the shell 8 of the main body 1, and the water fender 4 is a wall of the groove 11.

It can be seen from the description that the water fender 4 is easy to mold, which is convenient for the machining and production of the swimming pool cleaning robot. Furthermore, protruding areas of the main body 1 can be reduced, which can achieve minimization of the swimming pool cleaning robot and ensure that the water fender 4 is prevented from injuring people. It is conductive to improving the use safety of the swimming pool cleaning robot.

Embodiment I

Figure 2:
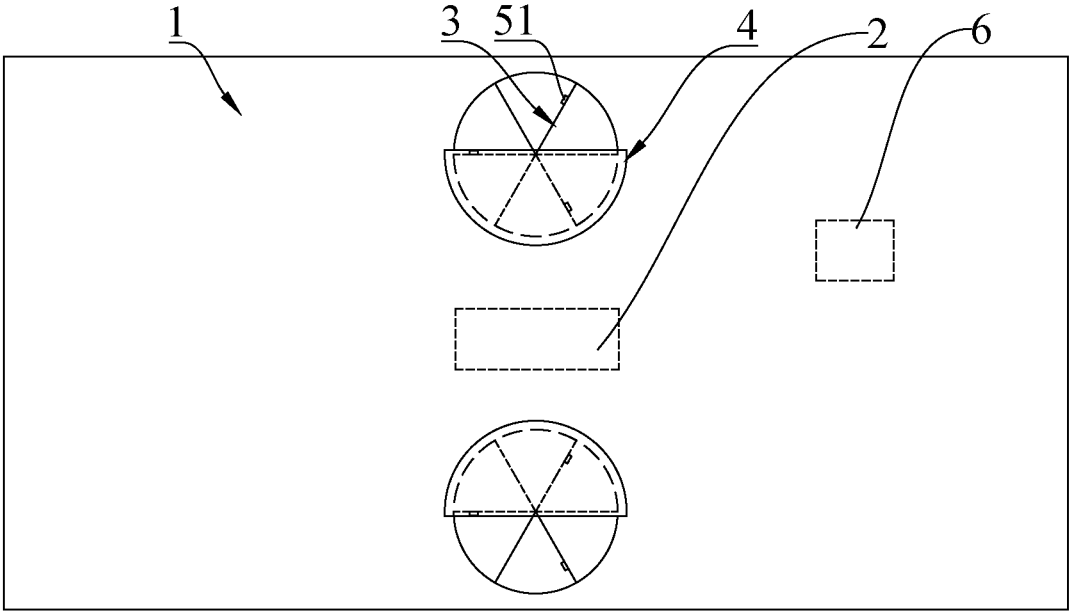
FIG. 2 is a top view of a swimming pool cleaning robot with a movement state detection function according to Embodiment I of the present disclosure.

Referring to FIG. 1 and FIG. 2, according to Embodiment I of the present disclosure, a swimming pool cleaning robot with a movement state detection function can detect its moving speed in a simple way.

The swimming pool cleaning robot with the movement state detection function includes a main body 1: the main body 1 includes a shell 8; a filter net is arranged in the shell 8; the filter net divides an inner cavity of the shell 8 into a turbid chamber and a clean chamber; a control module 2 is arranged on the main body 1; a rotating member 3 is rotatably arranged outside the main body 1; the rotating member 3 includes a rotating shaft part 31 and a plurality of vanes 32 outwards extending from the rotating shaft part 31; a water fender 4 is also arranged outside the main body 1; part of the rotating member 3 is located in the water fender 4, that is, part of the rotating member 3 is located in a half-surrounded structure; the swimming pool cleaning robot further includes a rotating speed detection assembly used for detecting a rotating speed of the rotating member 3; and the rotating speed detection assembly is electrically connected to the control module 2. Optionally, the rotating member 3 is a paddle wheel, and the water fender 4 is of a half-surrounded structure.

The rotating shaft part 31 and the vanes 32 of the rotating member 3 are of an integrally formed integrated structure, or the rotating shaft part 31 and the vanes 32 are detachably connected.

In order to detect a turning state of the swimming pool cleaning robot, there are a plurality of rotating members 3. Two opposite sides of the main body 1 are respectively provided with the rotating members 3. It is easily understood that when there are a plurality of rotating members 3, there are also a plurality of water fenders 4 which correspond to the plurality of rotating members 3 one to one. In addition, the two opposite sides of the main body 1 are not necessarily two opposite side surfaces of the main body 1. Areas close to side surfaces of the main body 1 can also be used as setting positions for the rotating members 3, such as areas of the top of the main body 1 close to the side surfaces of the main body 1. It should be noted that if only the moving speed of the swimming pool cleaning robot needs to be detected, only one rotating member 3, one rotating speed detection assembly and one water fender 4 are provided.

In order to ensure the waterproof effect of the swimming pool cleaning robot, the risk of damage to an electronic device is lowered. In this embodiment, the rotating speed detection assembly includes a magnet 51 and a detection element 52 which cooperate with each other; the magnet 51 is arranged on the rotating member 3, and the detection element 52 is arranged in the shell 8 of the main body 1. The detection element 52 is a Hall element or a reed pipe. It is easily understood that it is feasible that the magnet 51 is arranged on the vane 32 or the rotating shaft part 31. However, for convenience of the production and manufacturing of the swimming pool cleaning robot, preferably, the magnet 51 is arranged on the vane 32.

As a preferable implementation, there are a plurality of magnets 51 in the rotating speed detection assembly. The plurality of magnets 51 are uniformly distributed around a central axis of the rotating member 3. For example, when there are six vanes 32 in the rotating member 3, three of the vanes 32 can be selected to be respectively arranged on the magnets 51, and two adjacent magnets 51 along a circumferential direction are spaced apart from each other by 120°, or the six vanes 32 are all arranged on the magnets 51.

In this embodiment, the water fender 4 is detachably connected to a shell 8 of the main body 1. As such, it is convenient for the molding and manufacturing of the shell 8 of the main body 1. At the same time, when the water fender 4 is damaged, it can also be replaced. Connection ways for the water fender 4 and the shell 8 of the main body 1 include, but are not limited to, clamping, screw connection and the like. It should be noted that in some embodiments, it is also feasible that the water fender 4 and a shell 8 of the main body 1 are of an integrally formed integrated structure. For example, in the process of injection-molding of the shell 8 of the main body 1, the water fender 4 is synchronously molded.

In detail, the water fender 4 includes a recess part 41; one end of the recess part 41 is connected to the shell 8 of the main body 1, and the other end of the recess part 41 is provided with a cover part 42 for closing an end surface of the recess part 41; and a specific contour of the water fender 4 has a certain similarity to a daily used dustpan. In order to reduce the blocking effect of the rotating member 3 on a water flow, the rotating shaft part 31 of the rotating member 3 is preferably located in a sunken area of the recess part 41. In some embodiments, it is feasible that part of the rotating shaft part 31 or the entire rotating shaft part 31 of the rotating member 3 is exposed from the sunken area of the recess part 41. Optionally, an outer wall surface of the recess part 41 of the water fender 4 is streamlined, such as arc-shaped. In this way, resistance to the movement of the swimming pool cleaning robot can be reduced, which achieves the effects of improving the continuation capability of the swimming pool cleaning robot and saving energy.

In order to further improve the accuracy of detecting the movement state of the swimming pool cleaning robot, a gyroscope sensor 6 electrically connected to the control module 2 is also arranged on the main body 1. In addition, due to the existence of the gyroscope sensor 6, the control module 2 can sense a collision event (including, but not limited to, collision to a wall of a swimming pool and collision to handrails) of the swimming pool cleaning robot, so as to prevent the swimming pool cleaning robot from being locked, which improves the capacity of the swimming pool cleaning robot for getting out of troubles and is conductive to ensuring the working stability of the swimming pool cleaning robot. In detail, a collided object applies a counter-acting force to the swimming pool cleaning robot once there is a collision event to the swimming pool cleaning robot. This counter-acting force makes the swimming pool cleaning robot deflect to a certain extent. This deflection will be sensed by the gyroscope sensor 6.

The control module 2 receives a signal from the gyroscope sensor 6 and combines the signal with information indicating that a rotating speed of the rotating member 3 that is sent back by the rotating speed detection assembly is zero or close to zero. After it is confirmed that the swimming pool cleaning robot has a collision event and is stuck, the control module 2 controls the moving direction of the swimming pool cleaning robot to be changed, so that the swimming pool cleaning robot can get out of troubles.

Embodiment II

Figure 3:
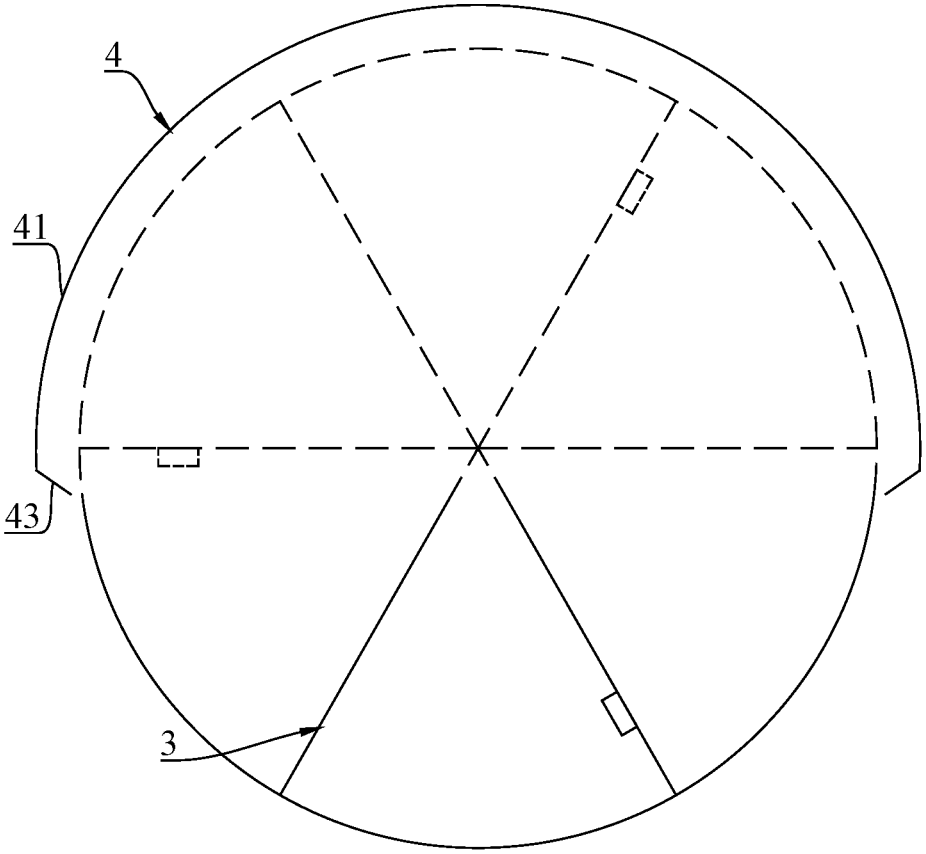
FIG. 3 is a partially simplified schematic structural diagram of a swimming pool cleaning robot with a movement state detection function according to Embodiment II of the present disclosure.

Referring to FIG. 3, Embodiment II of the present disclosure is a further optimization made on the basis of Embodiment I, and has a difference from Embodiment I below: In the water fender 4, guide plates 43 are respectively arranged on two sides of an opening of the recess part 41. By the arrangement of the guide plates 43, the phenomenon of turbulence of a water flow can be improved, which is conductive to improving the accuracy of a calculated result of the moving speed of the swimming pool cleaning robot. Particularly, when the swimming pool cleaning robot moves slowly, the guide plates 43 can increase an impact force of the water flow to the rotating member 3, thus ensuring that the moving speed of the swimming pool cleaning robot can also be detected even if the swimming pool cleaning robot moves slowly. Optionally, a driving member used for driving the guide plates 43 to rotate is also arranged on the main body. When the swimming pool cleaning robot moves slowly, the guide plates 43 spread to form an acute angle from the moving direction of the swimming pool cleaning robot, thus guiding and accelerating the water flow and enabling the water flow to drive the rotating member 3 to rotate by a higher impact force. When the swimming pool cleaning robot moves fast, the guide plates 43 retract. At this time, the guide plates 43 are parallel to the moving direction of the swimming pool cleaning robot, instead of guiding and accelerating the water flow. In this way, the accuracy of detecting the movement state of the swimming pool cleaning robot can be further improved.

Embodiment III

Figure 4:
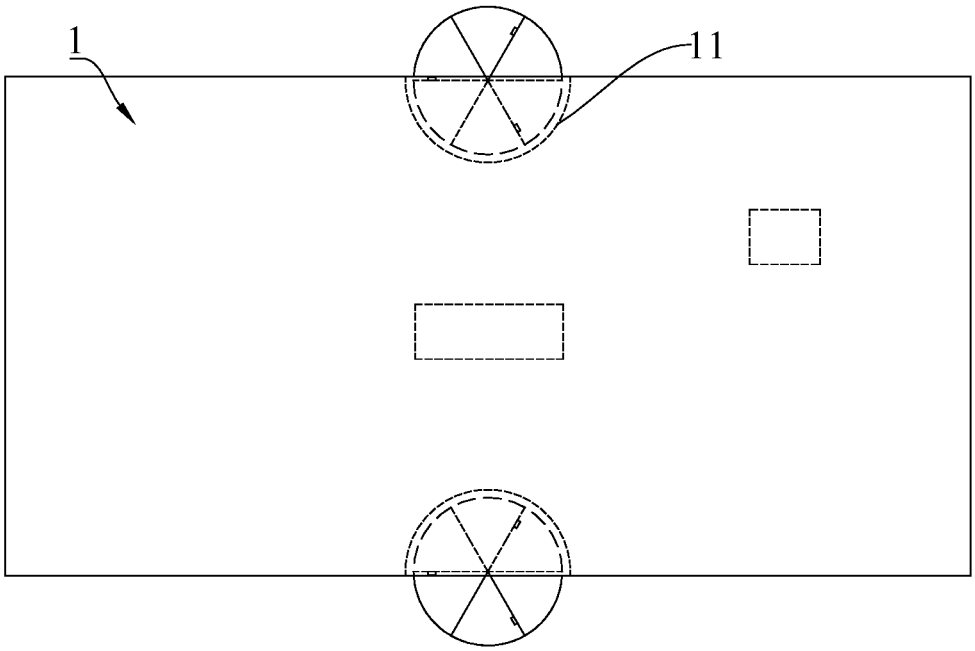
FIG. 4 is a top view of a swimming pool cleaning robot with a movement state detection function according to Embodiment Ill of the present disclosure.

Referring to FIG. 4, Embodiment III of the present disclosure is a parallel technical solution of Embodiment I, and has a difference from Embodiment I below: A groove 11 is arranged on a shell 8 of the main body 1. The water fender is a wall of the groove 11. In this embodiment. the groove 11 is located on a side wall of the shell 8 of the main body 1. In other embodiments, the groove 11 may also be arranged at the top of the main body 1.

Embodiment IV

Figure 5:
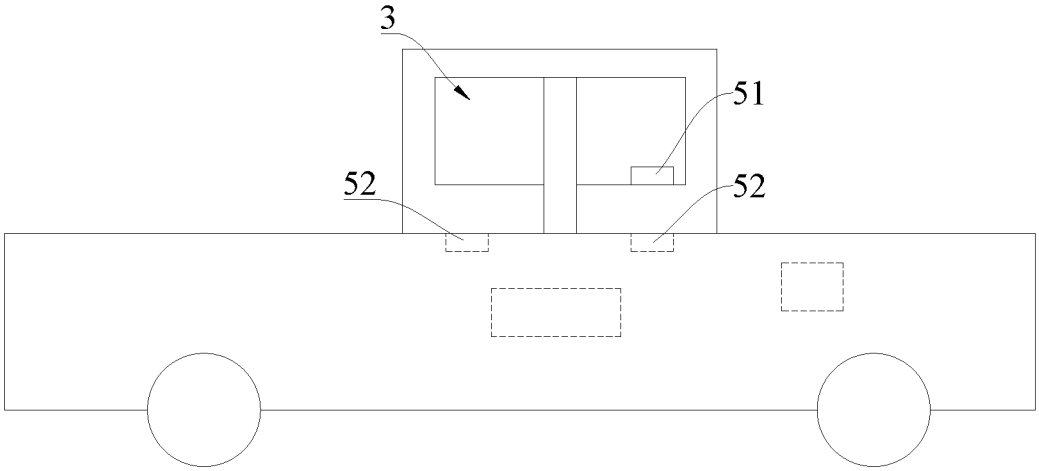
FIG. 5 is a simplified schematic diagram of a swimming pool cleaning robot with a movement state detection function according to Embodiment IV of the present disclosure.

Referring to FIG. 5, Embodiment IV of the present disclosure is a parallel technical solution of Embodiment I, and has a difference from Embodiment I below: there are a plurality of detection elements 52 in the rotating speed detection assembly. The plurality of detection elements 52 are uniformly distributed around a central axis of the rotating member 3. That is, in this embodiment, the single magnet 51 and the plurality of detection elements 52 form the rotating speed detection assembly. As such, the detection sensitivity and resolution of the rotating speed detection assembly can be improved. Furthermore, whether the swimming pool cleaning robot suddenly stops or reversely moves can be accurately acquired according to a change in an order that the magnet 51 triggers different detection elements 52.

Embodiment V

Figure 6:
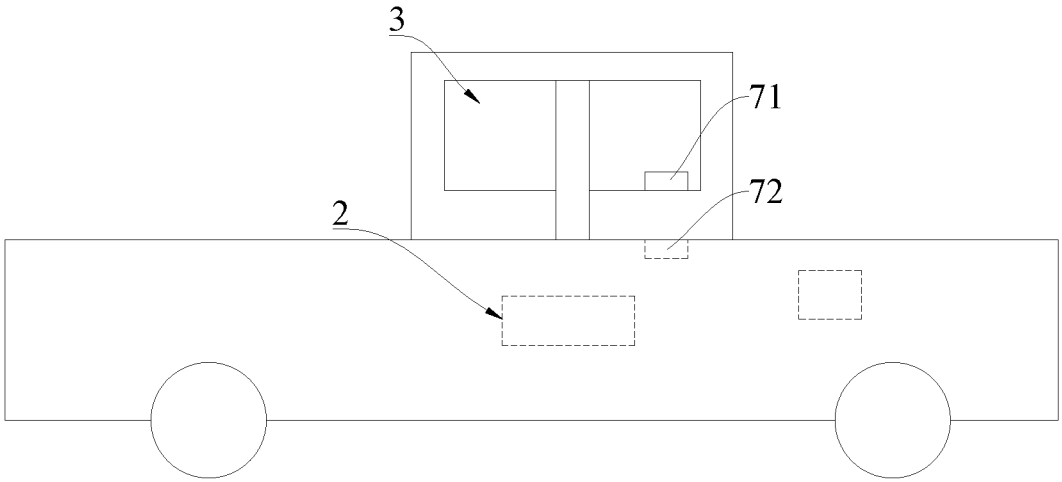
FIG. 6 is a simplified schematic diagram of a swimming pool cleaning robot with a movement state detection function according to Embodiment V of the present disclosure.

Referring to FIG. 6, Embodiment V of the present disclosure is a parallel technical solution of Embodiment I, and has a difference from Embodiment I below: The rotating speed detection assembly is a photoelectric sensor assembly: the photoelectric sensor assembly includes a first component 71 and a second component 72 which cooperate with each other; the first component 71 is arranged on the rotating member; and the second component 72 is arranged on the main body.

When the second component 72 is a laser emitter, the first component 71 is a sensor. Of course, the first component 71 may be a laser emitter, and at this time, the second component 72 is a sensor. The rotating member 3 rotates to drive the first component 71 to rotate. When the first component 71 passes through the position of the second component 72, the sensor receives light emitted by the laser emitter and generates a signal. The control module 2 can obtain the number of rotations of the rotating member 3 within unit time according to a signal generation frequency within unit time, thus obtaining the rotating speed of the rotating member 3. The moving speed of the swimming pool cleaning robot can be obtained according to a relationship (this relationship can be obtained by calibration) between the rotating speed of the rotating member 3 and the moving speed of the swimming pool cleaning robot.

In some embodiments, a combination of a light emitter and a light receiver can be selected as the second component 72, and at this time, the first component 71 is a light reflection member. The rotating member 3 rotates to drive the first component 71 to rotate. When the first component 71 passes through the position of the second component 72, the light receiver receives light emitted by the light emitter and reflected by the light reflection member, and generates a signal. The control module 2 can obtain the number of rotations of the rotating member 3 within unit time according to a signal generation frequency within unit time, thus obtaining the rotating speed of the rotating member 3. The moving speed of the swimming pool cleaning robot can be obtained according to a relationship (this relationship can be obtained by calibration) between the rotating speed of the rotating member 3 and the moving speed of the swimming pool cleaning robot.

In conclusion, the swimming pool cleaning robot with the movement state detection function provided by the present disclosure is provided with the rotating member and the rotating speed detection assembly used for detecting the rotating speed of the rotating member, so that the moving speed of the swimming pool cleaning robot can be accurately acquired by detecting the rotating speed of the rotating member, and the movement trajectory of the swimming pool cleaning robot can be controlled by controlling the moving direction of the swimming pool cleaning robot. The entire detection system has a simple and reliable structure and low manufacturing cost, and is convenient to maintain. Since the plurality of rotating members are arranged on the main body, a turning state of the swimming pool cleaning robot can be detected. The gyroscope sensor is added on the main body. The gyroscope sensor cooperates with the rotating speed detection assembly, which can improve the get-out possibility of the swimming pool cleaning robot and is conductive to ensuring the working stability of the swimming pool cleaning robot. Since the guide plates are arranged on the water fender, the accuracy of detecting the moving speed of the swimming pool cleaning robot can be improved.

The above descriptions are only the embodiments of the present disclosure, and are not intended to limit the patent scope of the present disclosure. Any equivalent structure made by using the content of the specification and drawings of the present disclosure and directly or indirectly applied to related technical fields shall all be similarly included in the scope of patent protection of the present disclosure.

The invention claimed is:

1. A swimming pool cleaning robot with a movement state detection function comprising a main body, wherein a control module is arranged on the main body; a rotating member is rotatably arranged outside the main body; a water fender is also arranged outside the main body; part of the rotating member is located in the water fender; the swimming pool cleaning robot further comprises a rotating speed detection assembly used for detecting a rotating speed of the rotating member; and the rotating speed detection assembly is electrically connected to the control module.

2. The swimming pool cleaning robot with the movement state detection function according to claim 1, wherein there are a plurality of rotating members, and two opposite sides of the main body are respectively provided with the rotating members.

3. The swimming pool cleaning robot with the movement state detection function according to claim 1, wherein the rotating speed detection assembly comprises a magnet and a detection element which cooperate with each other; the magnet is arranged on the rotating member, and the detection element is arranged in a shell of the main body; and the detection element is a Hall element or a reed pipe.

4. The swimming pool cleaning robot with the movement state detection function according to claim 3, wherein there are a plurality of magnets in the rotating speed detection assembly; the plurality of magnets are uniformly distributed around a central axis of the rotating member; or, there are a plurality of detection elements; and the plurality of detection elements are uniformly distributed around the central axis of the rotating member.

5. The swimming pool cleaning robot with the movement state detection function according to claim 3, wherein the rotating member comprises a rotating shaft part and a plurality of vanes extending outwardly from the rotating shaft part.

6. The swimming pool cleaning robot with the movement state detection function according to claim 5, wherein the rotating shaft part and the vanes are of an integrally formed integrated structure, or the rotating shaft part and the vanes are detachably connected.

7. The swimming pool cleaning robot with the movement state detection function according to claim 1, wherein the rotating speed detection assembly is a photoelectric sensor assembly; the photoelectric sensor assembly comprises a first component and a second component which cooperate with each other; the first component is arranged on the rotating member; and the second component is arranged on the main body.

8. The swimming pool cleaning robot with the movement state detection function according to claim 1, wherein a gyroscope sensor electrically connected to the control module is also arranged on the main body.

9. The swimming pool cleaning robot with the movement state detection function according to claim 1, wherein the water fender is detachably connected to a shell of the main body.

10. The swimming pool cleaning robot with the movement state detection function according to claim 1, wherein the water fender and a shell of the main body are of an integrally formed integrated structure.

11. The swimming pool cleaning robot with the movement state detection function according to claim 10, wherein a groove is arranged on the shell of the main body.

* * * * *